US009333665B2

(12) United States Patent
Niizeki

(10) Patent No.: US 9,333,665 B2
(45) Date of Patent: May 10, 2016

(54) CUTTER CARTRIDGE DEVICE, ADJUSTING JIG AND CUTTING APPARATUS

(71) Applicant: Tomoyasu Niizeki, Ichinomiya (JP)

(72) Inventor: Tomoyasu Niizeki, Ichinomiya (JP)

(73) Assignee: Brother Kogyo Kabushiki Kaisha, Nagoya-shi (KR)

( * ) Notice: Subject to any disclaimer, the term of this patent is extended or adjusted under 35 U.S.C. 154(b) by 162 days.

(21) Appl. No.: 14/212,056

(22) Filed: Mar. 14, 2014

(65) Prior Publication Data

US 2014/0260872 A1 Sep. 18, 2014

(30) Foreign Application Priority Data

Mar. 15, 2013 (JP) ..... 2013-053190

(51) Int. Cl.
*B26D 7/26* (2006.01)
*G01N 1/06* (2006.01)
*B26F 1/38* (2006.01)

(52) U.S. Cl.
CPC ..... *B26D 7/2628* (2013.01); *B26F 1/3813* (2013.01); *B26D 7/2614* (2013.01); *B26D 2007/2678* (2013.01); *Y10T 83/9488* (2015.04)

(58) Field of Classification Search
CPC ..... B26D 7/2628; B26D 7/2614; B26D 2007/2678; B26F 1/3813; Y10T 83/9488
USPC ..... 83/401, 698.11, 699.51, 76.1, 522.1, 83/284; 269/319; 30/DIG. 3
See application file for complete search history.

(56) References Cited

U.S. PATENT DOCUMENTS 3,118,228 A * 1/1964 Adams ..... B43M 7/002 30/294
3,477,322 A * 11/1969 Gerber ..... B26D 7/018 700/134
4,094,217 A * 6/1978 Exline ..... B26D 1/035 83/368
4,608,891 A * 9/1986 Frisby ..... B26D 7/2614 384/26
4,624,169 A * 11/1986 Nelson ..... B26D 3/085 33/1 M
4,713,886 A * 12/1987 Ikeda ..... B26F 1/32 30/361
5,197,198 A * 3/1993 Onozato ..... B26F 1/3806 33/1 M
6,131,498 A * 10/2000 Gerber ..... B26D 1/10 30/393
6,341,548 B1 * 1/2002 Hirahata ..... B26F 1/3813 83/699.41
6,997,095 B1 * 2/2006 Kishi ..... B26D 3/085 83/433
7,845,259 B2 * 12/2010 Workman ..... B26D 7/2614 83/436.3
7,930,958 B2 * 4/2011 Workman ..... B26D 7/2628 30/161
2005/0186010 A1 * 8/2005 Shibata ..... B26D 7/015 400/621
2007/0227332 A1 * 10/2007 Causse ..... B26D 7/015 83/879
2010/0199827 A1 * 8/2010 Colegrove ..... B26D 7/025 83/651
2011/0280999 A1 * 11/2011 Crystal ..... A21C 15/002 426/231
2012/0253504 A1 * 10/2012 Kawaguchi ..... B26F 1/3813 700/187

FOREIGN PATENT DOCUMENTS

JP H06-66989 U 9/1994
JP 2005-212050 A 8/2005
JP 2013-78813 A 5/2013

* cited by examiner

*Primary Examiner* — Ghassem Alie
*Assistant Examiner* — Bharat C Patel
(74) *Attorney, Agent, or Firm* — Fox Rothschild LLP

(57) ABSTRACT

A cutter cartridge device includes a cartridge having a cutter including a blade portion configured so that an amount of projection from the cartridge is changeable and an adjusting jig including an attachment portion and a holder portion configured to hold a sheet-shaped object. The cartridge includes a body and a cap threadingly engageable with the body so as to be rotatable. The cap is moved in the lengthwise direction according to its rotation, thereby changing the projection amount of the blade portion. The blade portion contacts the moving member to press the moving member so that the moving member is moved in the lengthwise direction. The adjusting jig further includes a biasing member configured to bias the moving member in a direction such that the second holding portion comes close to the first holding portion.

5 Claims, 11 Drawing Sheets

FRONT END SIDE ⟷ REAR END SIDE

CUTTER CARTRIDGE DEVICE, ADJUSTING JIG AND CUTTING APPARATUS

CROSS-REFERENCE TO RELATED APPLICATIONS

This application is based upon and claims the benefit or priority from the prior Japanese Patent Application No. 2013-053190 filed on Mar. 15, 2013, the entire contents of which are incorporated herein by reference.

BACKGROUND

1. Technical Field

The present disclosure relates to a cutter cartridge device including a cartridge and an adjusting jig, the adjusting jig and a cutting apparatus including the cutter cartridge device or a cutting apparatus including the cartridge and the adjusting jig.

2. Related Art

A cutting apparatus, such as so-called cutting plotter, has been conventionally known which cuts an object to be cut, such as paper or cloth, into a desired configuration. A cutter holder (corresponding to a cartridge) is detachably attached to this type of cutting plotter. In this case, the cutter holder includes a cylindrical holder portion holding a cutter therein and a cap which is threadingly engaged with the holder portion to cover a distal end of the holder portion. The cap has a bottom formed with a protruding hole through which a blade edge (a blade part) of the cutter is allowed to appear and disappear. The user can adjust an amount of projection of the blade portion front the bottom of the cap by turning the cap.

When the amount of projection of the blade portion is smaller than a thickness of the object, a part of the object cannot be cut out from the object with the result that poor cutting occurs. On the other hand, when the amount of projection of the blade portion is larger than the thickness of the object, the blade portion makes a deep cutting mark in a holding member holding the object and/or the blade portion is early worn out.

In view of the above-described problem, a projection amount of the blade portion is required to be adjusted to a proper dimension slightly larger than the thickness of the object. However, since the blade portion is small and paper and cloth serving as the object to be cut have respective small thicknesses, a projection amount of the blade portion is obviously small. Accordingly, the user has a difficulty in visually adjusting a projection amount of the blade portion properly.

SUMMARY

Therefore, an object of the disclosure is to provide a cutter cartridge device, an adjusting jig and a cutting apparatus, all of which can easily adjust a projection amount of the blade portion of the cutter to a proper amount.

The present disclosure provides a cutter cartridge device including a cartridge having a cutter including a blade portion, the blade portion being configured so that an amount of projection thereof projecting from the cartridge is changeable, an adjusting jig including an attachment portion configured so that the cartridge is detachably attached to the attachment portion and a holder portion configured to hold a sheet-shaped cut object from both thicknesswise ends with respect to the cut object, the holder portion having a spacing which is changed in conjunction with a change in the projection amount of the blade portion of the cartridge attached to the attachment portion. The cartridge further includes a body extending in a lengthwise direction and having a distal end holding the cutter and a cap having a hole through which the blade portion is capable of penetrating. The cap covers the cutter and is threadingly engageable with the body so as to be rotatable. The cap is moved in the lengthwise direction according to rotation of the cap, thereby changing the projection amount of the blade portion projecting from the hole. The attachment portion has a base member configured to hold the cap so that the cap is rotatable and immovable in the lengthwise direction. The base member is further configured to hold the body so that the body is non-rotatable and movable in the lengthwise direction. The holder portion has a first holding portion formed integrally with the base member and a second holding portion formed integrally with a moving member and configured to be abuttable on the first holding portion. The moving member is supported on the base member so as to be movable in the lengthwise direction. The blade portion contacts the moving member thereby to press the moving member so that the moving member is moved in the lengthwise direction. The adjusting jig further includes a biasing member configured to bias the moving member is a direction such that the second holding portion comes close to the first holding portion.

The disclosure also provides an adjusting jig including an attachment portion configured so that a cartridge is detachably attached to the attachment portion thereto, the cartridge being provided with a cutter having a blade capable of appearing out of and disappearing into the cartridge, the blade being changeable in an amount of projection from the cartridge, and a holder portion configured to hold a sheet-shaped cut object from both thicknesswise ends with respect to a cut object, the holder portion having a spacing which is changed in conjunction with a change in the projection amount of the blade portion of the cartridge attached to the attachment portion. The attachment portion has a base member configured to hold a cap of the cartridge so that the cap is rotatable and immovable in the lengthwise direction. The base member is further configured to hold a body of the cartridge so that the body is non-rotatable and movable in the lengthwise direction. The holder portion has a first holding portion formed integrally with the base member and a second holding portion formed integrally with a moving member and configured to be abuttable on the first holding portion. The moving member is supported on the base member so as to be movable in the lengthwise direction. The blade portion contacts the moving member thereby to press the moving member so that the moving member is moved in the lengthwise direction. The adjusting jig further includes a biasing member configured to bias the moving member in a direction such that the second holding portion comes close to the first holding portion.

The disclosure further provides a cutting apparatus including a cartridge having a cutter including a blade portion, the blade portion being configured so that an amount of projection thereof projecting from the cartridge is changeable, an adjusting jig including an attachment portion configured so that the cartridge is detachably attached to the attachment portion, a holder portion configured to hold a sheet-shaped cut object from both thicknesswise ends with respect to the cut object, the holder portion having a spacing which is changed in conjunction with a change in the projection amount of the blade portion of the cartridge attached to the attachment portion, a holding member configured to hold the object, and a moving unit configured to move the holding member and the cartridge relative to each other. The cartridge further includes a body extending in a lengthwise direction and having a distal end holding the cutter and a cap having a hole through which the blade portion is capable of penetrating. The cap covers the cutter and is threadingly engageable with the body so as to be rotatable. The cap is moved in the lengthwise direction according to rotating of the cap, thereby changing the projection amount of the blade portion projecting from the hole. The attachment portion has a base member configured to hold the cap so that the cap is rotatable and immovable in the lengthwise direction. The base member is further configured to hold the body so that the body is non-rotatable and movable in the lengthwise direction. The holder portion has a first holding portion formed integrally with the base member and a second holding portion formed integrally with a moving member and configured to be abuttable on the first holding portion. The moving member is supported on the base member so as to be movable in the lengthwise direction. The blade portion contacts the moving member thereby to press the moving member so that the moving member is moved in the lengthwise direction. The adjusting jig further includes a biasing member configured to bias the moving member in a direction such that the second holding portion comes close to the first holding portion.

DETAILED DESCRIPTIONS

Figure 1:
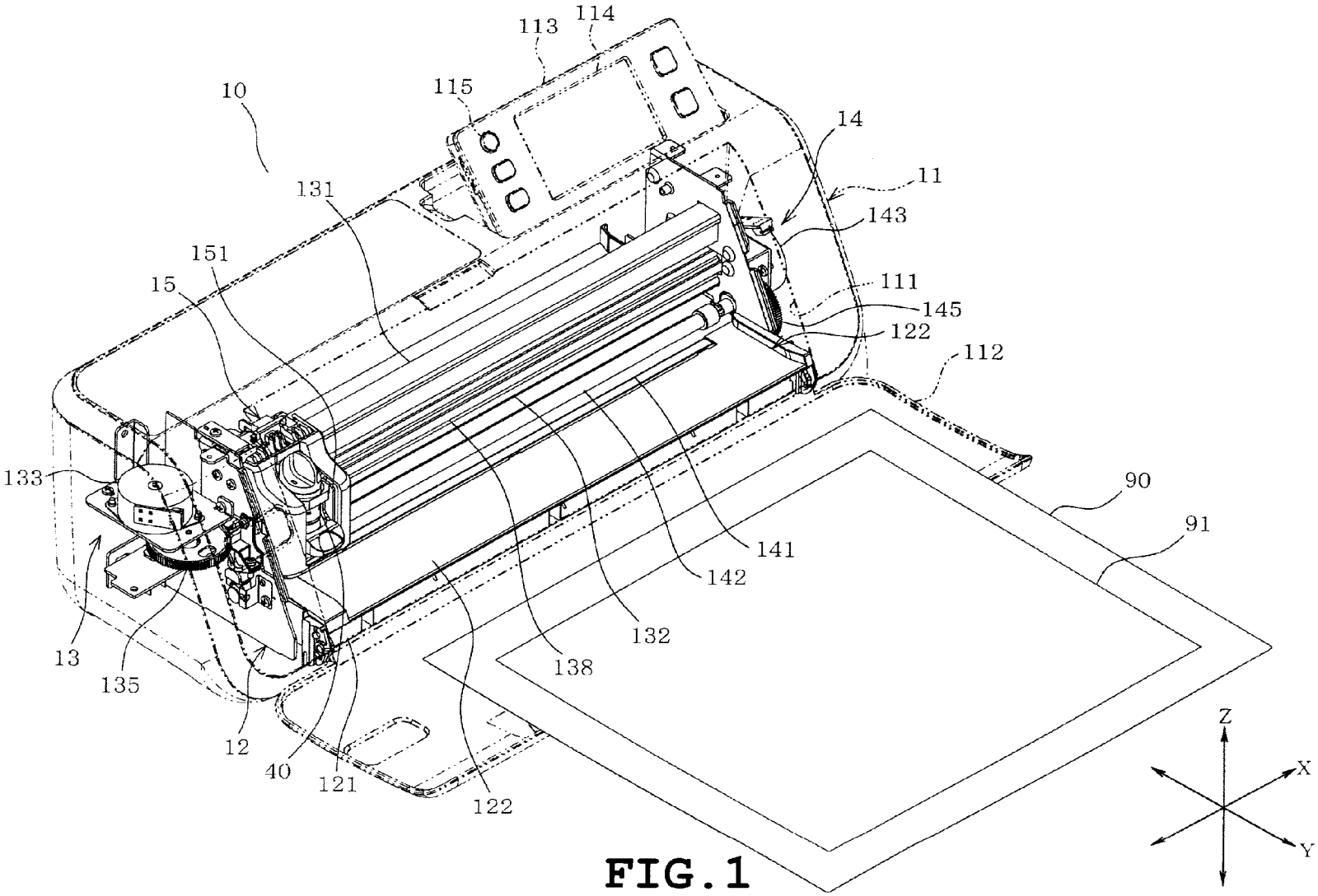
FIG. 1 is a perspective view of a cutting apparatus according to one example.
Figure 2:
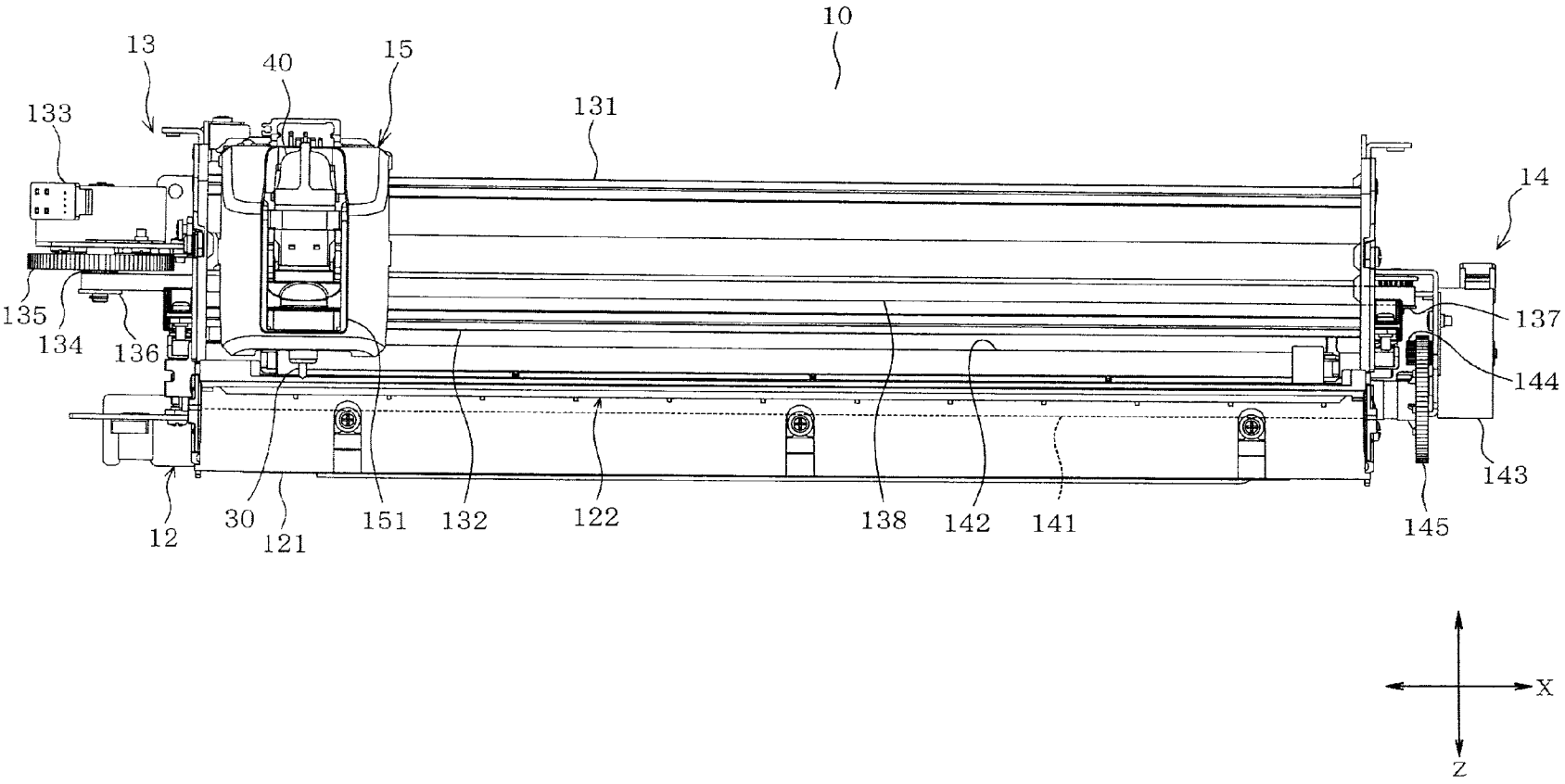
FIG. 2 is a front view of the cutting apparatus with a body cover being detached.

A cutter cartridge device, an adjusting jig and a cutting apparatus according to one example will be described with reference to the accompanying drawings. Referring to FIGS. 1 and 2, the cutting apparatus 10 is shown which cuts an object 91 held by a holding member 90 into a desired shape. The holding member 90 is a flat plate made of a resin and having an adhesive layer (not shown) on a surface thereof. The holding member 90 holds the object 91 such as cloth or paper affixed to the adhesive layer. The cutting apparatus 10 includes a body cover 11, a cutting apparatus body 12, an X-axis moving mechanism 13, a Y-axis moving mechanism 14 and a carriage 15, as shown in FIGS. 1 and 2. The cutting apparatus 10 also includes a cartridge 40 provided with a cutter 30 as shown in FIG. 2. The cartridge 40 is detachably attached to the carriage 15 as shown in FIG. 2.

The body cover 11 is formed into the shape of a rectangular box as a whole and covers the body 12, the X-axis moving mechanism 13, the Y-axis moving mechanism 14, the carriage 15 and the cartridge 40. In the following description, a lengthwise direction of the body cover 11 will be referred to as "right-left direction." The side where an opening 111 is located will be referred to as "front" of the cutting apparatus 10. A right-left direction relative to the cutting apparatus 1 will be referred to as "X-axis direction." A front-rear direction relative to the cutting apparatus 1 will be referred to as "Y-axis direction." An up-down direction relative to the cutting apparatus 1 will be referred to as "Z-axis direction."

The opening 111 is formed in a front of the body cover 11. The body cover 11 also has another opening (not shown) which is formed in a rear surface so as to be opposed to the opening 111 and through which the holding member 90 is passable. The body cover 11 includes a front cover 112 and an operation panel 113. The front cover 112 has a lower end pivotally mounted on the body cover 11, so that the front cover 112 is rotated between a first position where the opening 111 is opened and a second position where the opening 111 is closed. The operation panel 113 is mounted on a top of the body cover 11 and includes an input display 114 configured of a touch liquid crystal display and a plurality of switches 115, for example. The user operates the touch liquid crystal display 114 and the operation panel 113 to make various settings and to confirm operating conditions.

The body 12 includes a base 121 and a receiving mechanism 122. The base 121 is provided on a bottom of the body cover 11 and formed into the shape of a rectangular frame. The receiving mechanism 122 is formed into the shape of a substantially horizontal flat plate. A holding member holding the object 91 is placed on the receiving mechanism 122. When the object 91 is cut, the receiving mechanism 122 is subjected to pressure a lower end of the cartridge 40 applies to the object 91 and the holding member 90.

The X-axis moving mechanism 13 moves the carriage 15 in the X direction, that is, in the right-left direction. The X-axis moving mechanism 13 includes a pair of upper and lower X-axis guide rails 131 and 132, an X-axis motor 133, an X-axis driving gear 134, an X-axis driven gear 135, a pair of timing pulleys 136 and 137 and a timing belt 138. The X-axis guide rails 131 and 132 extend horizontally one above the other. The X-axis motor 133 is comprised of a stepping motor, for example. Rotation of the X-axis motor 133 is transmitted to the X-axis driving gear 134, which is rotated with a rotational shaft of the X-axis motor 133. The X-axis driven gear 135 is in mesh engagement with the X-axis driving gear 134.

The left timing pulley 136 is provided below the X-axis driven gear 135. The X-axis timing pulley 136 is rotated together with the X-axis driven gear 135 with rotation of the X-axis driven gear 135. The timing belt 138 extends between the left and right timing pulleys 136 and 137. The timing belt 138 includes a part connected to the carriage 15.

In the above-described construction, when the X-axis motor 133 is rotated, rotation thereof is transmitted to the timing belt 138 via the X-axis driving gear 134, the X-axis driven gear 135 and the left timing pulley 136. As a result, the carriage 15 is moved in the X direction, that is, in the right-left direction with the movement of the timing belt 138.

The Y-axis moving mechanism 14 moves the object 91 held by the holding member 90 in the Y direction, that is, in the front-rear direction. The Y-axis moving mechanism 14 includes a driving roller 141, a pinch roller 142, a Y-axis motor 143, a Y-axis driving gear 144 and a Y-axis driven gear 145. The driving roller 141 and the pinch roller 142 extend in parallel to the X-axis guide rails 131 and 132 so that central axes of the rollers 141 and 142 are directed in the right-left direction, that is, in the X direction. The holding member 90 disposed between the driving roller 141 and the pinch roller 142 is pressed against the driving roller 141 by the pinch roller 142.

The Y-axis motor 143 is comprised of a stepping motor, for example. Rotation of the Y-axis motor 143 is transmitted to the Y-axis driving gear 144, which is rotated together with a rotational shaft of the Y-axis motor 143. The Y-axis driven gear 145 is provided on a right end of the driving roller 141. The Y-axis driven gear 145 is in mesh engagement with the Y-axis driving gear 144.

In the above-described construction, when the Y-axis motor 143 is rotated, rotation thereof is transmitted to the driving roller 141 via the Y-axis driving and driven gears 144 and 145. Rotation of the driving roller 141 is transmitted to the holding member 90 held between the driving roller 141 and the pinch roller 142. As a result, the holding member 90 is moved in the Y direction perpendicular to an axial direction of the driving roller 141.

The carriage 15 includes a cartridge holder 151 and a Z-axis moving mechanism. The cartridge holder 151 is provided in front of the carriage 15 and holds the cartridge 40 so that the cartridge 40 is detachably attachable. The cartridge 40 is fixed to the cartridge holder 151 while the blade of the cutter 30 is exposed as shown in FIG. 2. A Z-axis moving mechanism (not shown) is provided inside the carriage 15 to move the cartridge holder 151 in the up-down direction, that is, in the Z direction together with the cartridge 40.

In the above-described construction, when the cartridge holder 151 is moved downward by the Z-axis moving mechanism, a distal end of the cutter 30 mounted to the cartridge 40 bites into the object 91 held on the sheet-shaped holding member 90. In the state where the distal end of the cutter 30 bites into the object 91, the carriage 15 is moved in the X direction by the X-axis moving mechanism 13 and the object 91 is moved in the Y direction by the Y-axis moving mechanism 14, whereby a desired shape is cut out of the object 91. In this case, the X-axis moving mechanism 13, the Y-axis moving mechanism 14 and the Z-axis moving mechanism function as a moving unit which relatively moves the holding member 90 and the carriage 15 provided with the cartridge 40 in order that the object 91 may be cut.

Figure 3:
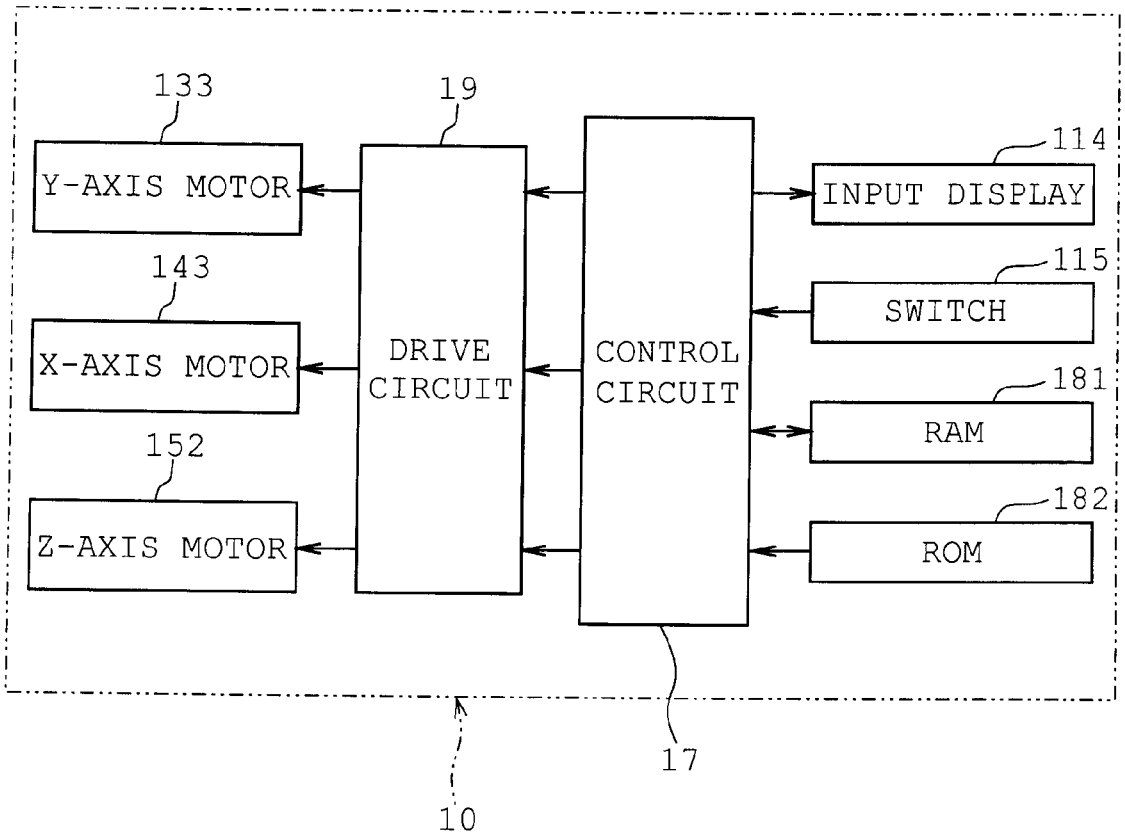
FIG. 3 is a schematic block diagram showing an electrical arrangement of the cutting apparatus.

The cutting apparatus 10 includes a control circuit 17 as shown in FIG. 3. The control circuit 17 is comprised of a central processing unit (CPU) and controls the entire cutting apparatus 10. To the control circuit 17 are connected the input display 114 and the switch 115 of the operation panel 113, a RAM 181, a ROM 182 and a drive circuit 19. The RAM 181 stores cutting data to drive the motors 133, 143 and 152 in order that a desired shape may be cut out of the object 91, and the like. The ROM 182 stores a drive control program to control the motors 133, 143 and 152 on the basis of the cutting data stored in the RAM 181. The drive circuit 19 drives the motors 133, 143 and 152 based on instructions from the control circuit 17. The cutting apparatus 10 farther includes a cutter cartridge device 20 as shown in FIG. 4. The cutter cartridge device 20 includes a cartridge 40 provided with the replaceable cutter 30 and an adjusting jig 50 to which the cartridge 40 is detachably attached.

Figure 4A:
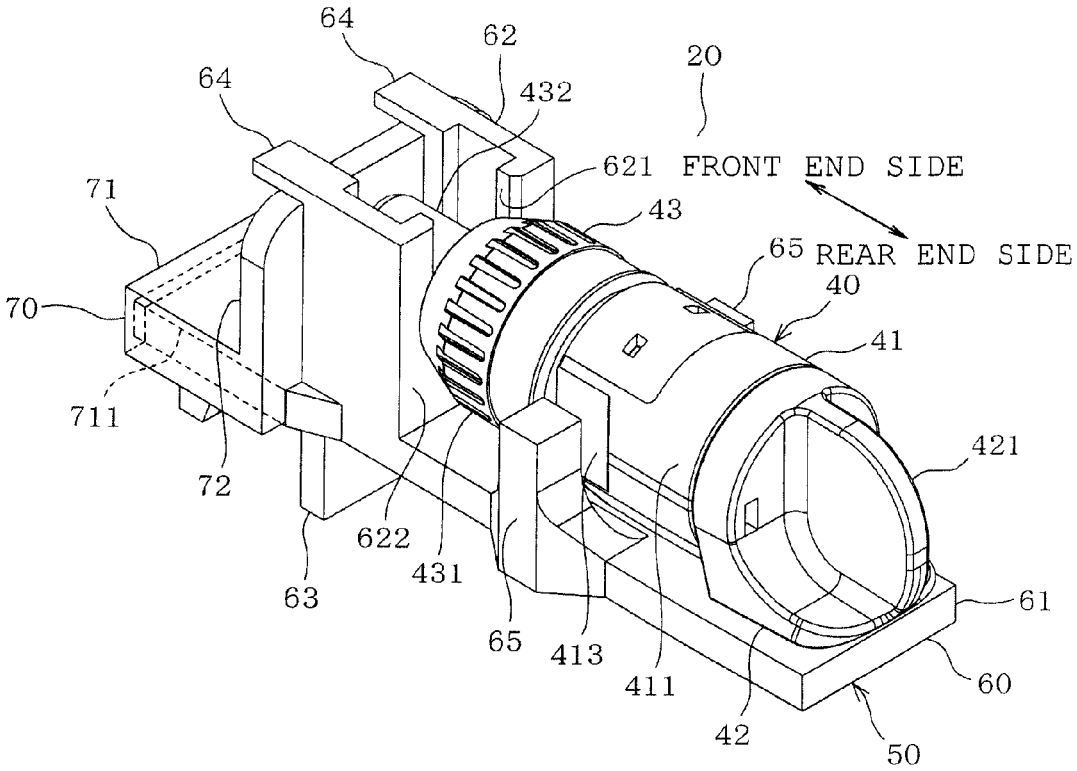
FIGS. 4A and 4B are perspective views of a cutter cartridge.
Figure 4B:
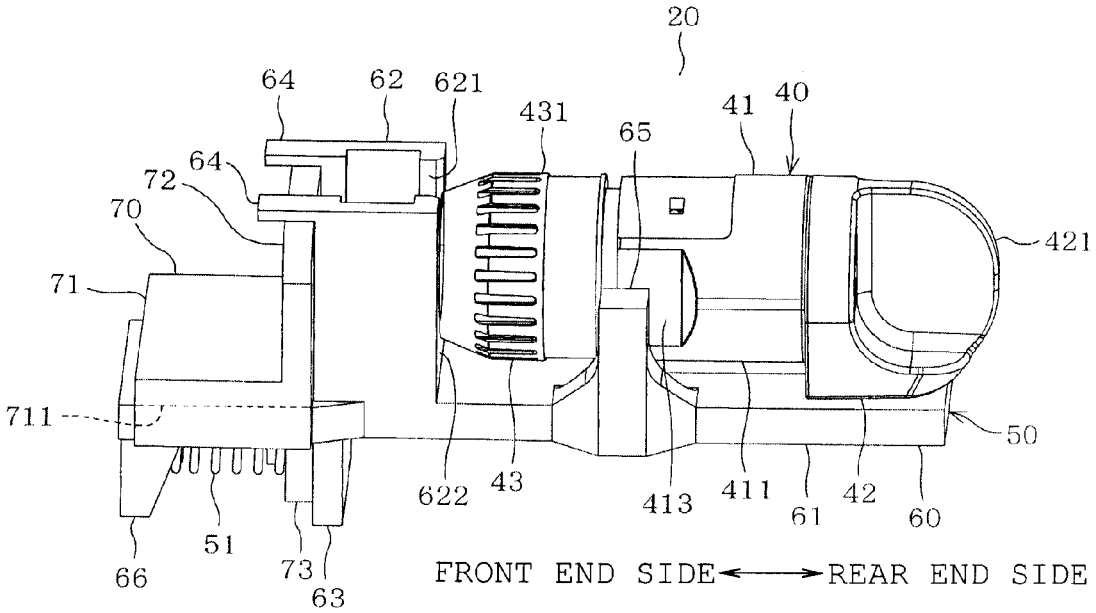
Figure 5A:
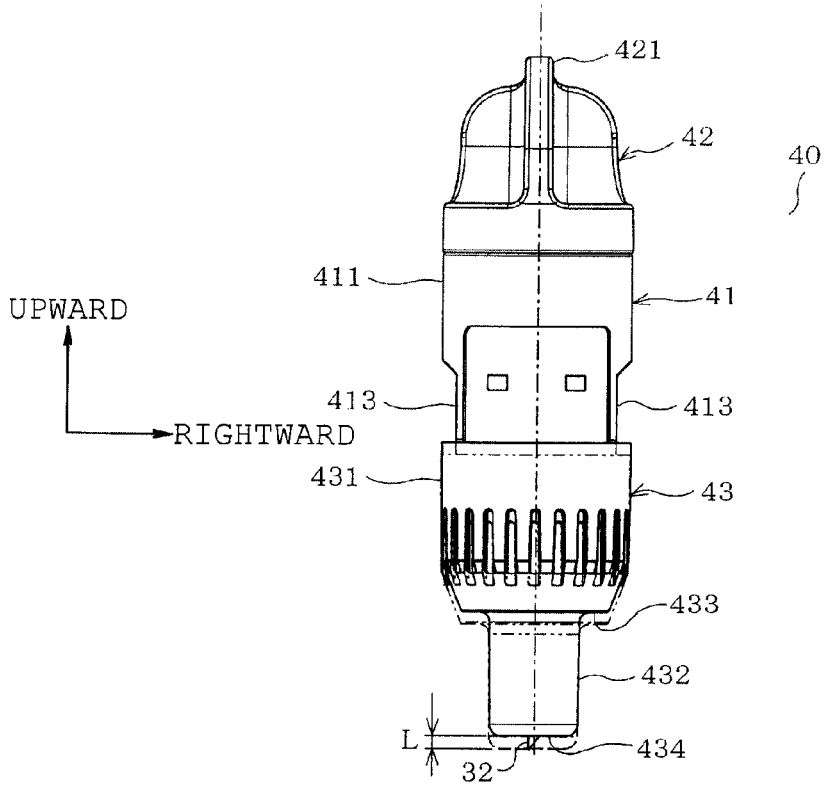
FIGS. 5A, 5B and 5C are a front view, a longitudinally sectional front view and a longitudinally sectional side view of a cartridge.
Figure 5B:
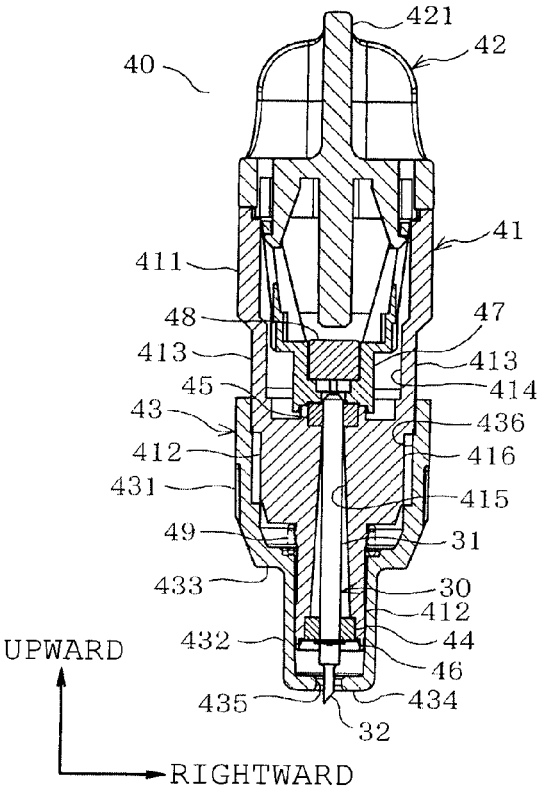
Figure 5C:
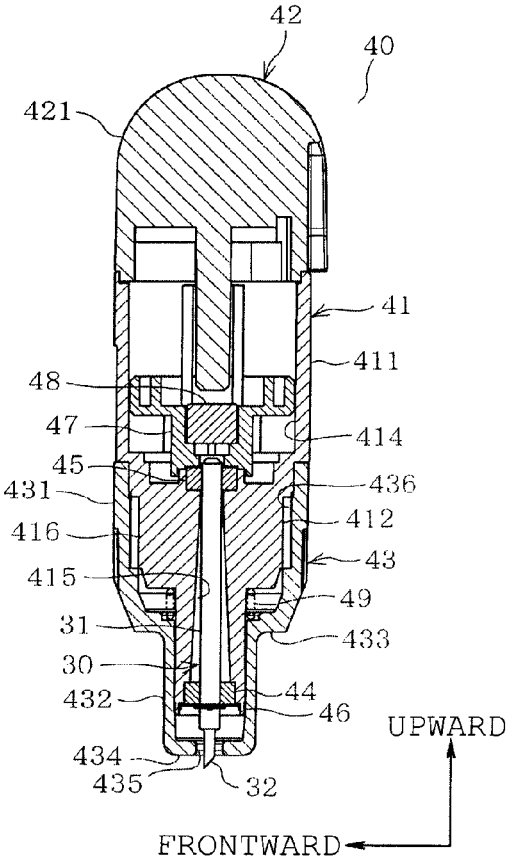

The cutter cartridge device 20 will now be described with reference to FIGS. 4 to 11. FIGS. 4 and 6A and 6B to 11 show the cutter cartridge device 20 or the adjusting jig 50 in the usage state. In this case, the side located at a left upper part in FIGS. 4A, 4B, 6A and 6B will he referred to as a front side of the cutter cartridge device 20 or the adjusting jig 50. The side located at a right part in FIGS. 4A, 4B, 6A and 6B will be referred to as a rear side of the cutter cartridge device 20 or the adjusting jig 50. Furthermore, in FIGS. 7A to 11, a left part in FIGS. 7A to 11 will be referred to as a front end side of the cutter cartridge device 20 and a right part in FIGS. 7A to 11 will be referred to as a rear end side of the cutter cartridge device 20. Additionally, FIG. 5 shows the cartridge 40 in the mounted state. In this case, the lower side of FIGS. 5A to 5C is a lower part of the cartridge 40 and the upper part of FIGS. 5A to 5C is an upper part of the cartridge 40.

The cartridge 40 will be firstly described with FIGS. 5A to 5C. The cartridge 40 includes a body 41, a dog 42, a cap 43 and a cutter 30. The cutter 30 has a cylindrical shaft 31 extending in a lengthwise direction and a blade 32 provided on a distal end of the shaft 31, both of which are formed integrally with the cutter 30. Note that the cutter 30 should not be limited to the above-described construction but may have a cylindrical shaft with a distal end on which a flat-plate-shaped blade is provided.

The body 41 is made of resin and formed to be long in the lengthwise direction or in the up-down direction in FIGS. 5A to 5C. The body 41 has a lower part having a smaller outer diameter than an upper part thereby to be formed into a two-staged cylindrical shape. More specifically, the body 41 has a body larger-diameter part 411 and a cylindrical body smaller-diameter part 412 provided below the body larger-diameter part 411 and having a smaller outer diameter than the larger-diameter part 411. These parts 411 and 412 are formed integrally with the body 41. Additionally, the body 41 has two flat surfaces 413 formed by cutting outer circumferential portions into a flat shape opposed to each other.

A housing chamber 414 and an insertion part 415 are formed inside the body 41. The housing chamber 414 is located inside the body larger-diameter part 411 and formed by recessing a part of the body larger-diameter part 411 from an upper end to a middle portion of the larger-diameter part 411. The insertion part 415 is formed in a frustoconical space narrowing from the body smaller-diameter part 412 toward the body larger-diameter part 411, extending from the body smaller-diameter part 412 to a lower end of the boy larger-diameter part 411. The insertion part 415 has an upper end communicating with an interior of the housing chamber 414.

The body 41 encloses therein a first bearing 44, a second bearing 45, a retainer ring 46, a fixing member 47 and a magnet 48. The first bearing 44 is a rolling bearing such as a ball bearing and is provided inside the body smaller-diameter part 412 corresponding to a lower end of the insertion part 415. The retainer ring 46 is provided inside the body smaller-diameter part 412 so as to be located below the first bearing 44. The retainer ring 46 fixes the first bearing 44 to the inside of the body smaller-diameter part 412 so that the first bearing 44 is prevented from dropping off from the insertion part 415.

The second bearing 45 is a slide bearing formed of a metal alloy, for example, and is provided on the upper end of the insertion part 415 or the bottom of the housing chamber 414. The fixing member 47 is provided above the insertion part 415 in the housing chamber 414. The second bearing 45 is fixed to the bottom of the housing chamber 414 by the fixing member 47 so that the second bearing 45 is prevented from dropping off from the insertion part 415. The magnet 48 is located above the upper end of the insertion part 415 and embedded in the fixing member 47. A male thread 416 is provided on an outer periphery of the body larger-diameter part 411 so as to extend from the lower end of the body larger-diameter part 411 near to the bottom of the housing chamber 414.

The dog 42 is made of resin and provided on the upper end of the body 41 so as to close an upper opening of the housing chamber 414. The dog 42 has a knob 421 formed into an arc-shaped curved surface without flat part.

The cap 43 is made of a resin and has a lower part having a smaller outer diameter than an upper part, whereby the cap 43 is formed into a two-staged cylindrical shape. More specifically, the cap 43 has a cap larger-diameter part 431 and cap smaller-diameter part 432 both formed integrally with the cap 43. The cap larger-diameter part 431 has a slightly larger inner diameter than an outer diameter of the body smaller-diameter part 412. A stepped portion 433 is formed between the cap larger-diameter part 431 and the cap smaller-diameter part 432.

The cap smaller-diameter part 432 has a lower end provided with a pressing surface 434 which is formed into a circular flat surface. In cutting the object 91, the pressing surface 434 contacts an upper surface of the object 91 thereby to press the object 91. The pressing surface 434 has a centrally located circular through hole 435. The hole 435 communicates between the interior and the exterior of the cap 43, whereby the blade 32 of the cutter 30 held by the body 41 can pass through the hole 435. A female thread 436 is provided on the inside of the cap larger-diameter part 431. The female thread 436 is threadingly engaged with the male thread formed on the outer periphery of the body larger-diameter part 411. More specifically, the cap 43 threadingly engages the body 41 so as to be rotatable.

In the above-described construction, the user detaches the cap 43 from the body 41 and then attaches the cutter 30 to the body 41. When the shaft 31 of the cutter 30 is inserted through the first and second bearings 44 and 45, the upper end of the shaft 31 is attracted by the magnet 48. As a result, the cutter 30 is held on the body 41 so as to be rotatable. Subsequently, the user attaches the cap 43 to the body 41. Thus, the blade 32 is allowed to appear and disappear through the hole 435 of the cap 43 and a projection amount of the blade 32 is changeable while the cutter 30 is covered with the cap 43.

More specifically, the blade 32 of the cutter 30 is caused to protrude out of the hole 435 through the hole 435 of the distal end of the cap 43 according to the location of the cap 43. A projection amount L of the cutter 30 protruding from the hole 435 is changed in the following manner. The cap 43 is rotated while the body 41 is fixed so as to be non-rotatable. As a result, the female thread 436 of the cap 43 is rotated relative to the male thread 416 of the body 41. The cap 43 is then moved in the lengthwise direction of the body 41 or in the up-down direction in FIG. 5 according to the rotation thereof, whereby the projection amount L of the cutter 30 is changed. Thus, the projection amount L of the blade 32 of the cutter 30 is changed according to the rotation of the cap 43.

A compression coil spring 49 is provided inside the cap larger-diameter part 431 and outside the body smaller-diameter part 412. The compression coil spring 49 is located between the lower end of the body larger-diameter part 411 of the body 41 and the bottom of the cap larger-diameter part 431 of the cap 43. The compression coil spring 49 biases the body 41 and the cap 43 so that both are departed from each other in the up-down direction. This suppresses the loosening and slip resulting from the threading engagement of the male thread 416 of the body larger-diameter part 411 and the female thread 436 of the cap larger-diameter part 431. Consequently, the location of the cap 43 relative to the body 41, namely, the projection amount L of the cutter 30 can be adjusted accurately.

The adjusting jig 50 will now be described with reference to FIGS. 6A to 7B. The cartridge 40 is detachably attached to the adjusting jig 50. The adjusting jig 50 is provided for properly adjusting the projection amount L of the blade 32 of the cutter 30 provided in the cartridge 40. The adjusting jig 50 includes a base member 60, a moving member 70 and a compression coil spring 51. The base member 50 and the moving member 70 are made of resin, for example, but may be made of a metal. The base member 60 functions as an attachment portion to which the cartridge 40 is detachably attachable. The base member 60 includes a plate portion 61, a support portion 62, a first holding portion 63, a retainer portion 64, a preventing portion 65 and a spring-shoe 66, all of which are integrally formed with the base member 60. The plate portion 61 is formed into a rectangular plate shape and has a larger width and length than the cartridge 40 (the right-left dimension and the up-down dimension in FIG. 5). The plate portion 61 has a rectangular through hole 611 which is formed near a front end thereof in a lengthwise direction so as to extend through the plate portion 61.

Figure 6A:
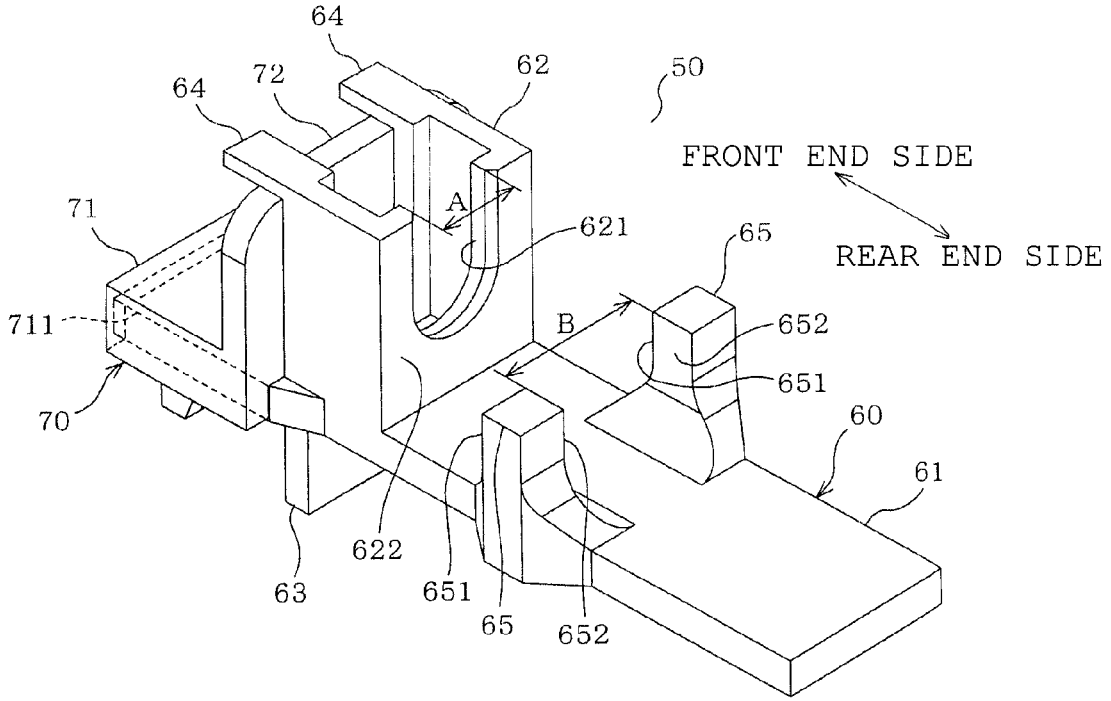
FIGS. 6A and 6B are perspective views of an adjusting jig.
Figure 6B:
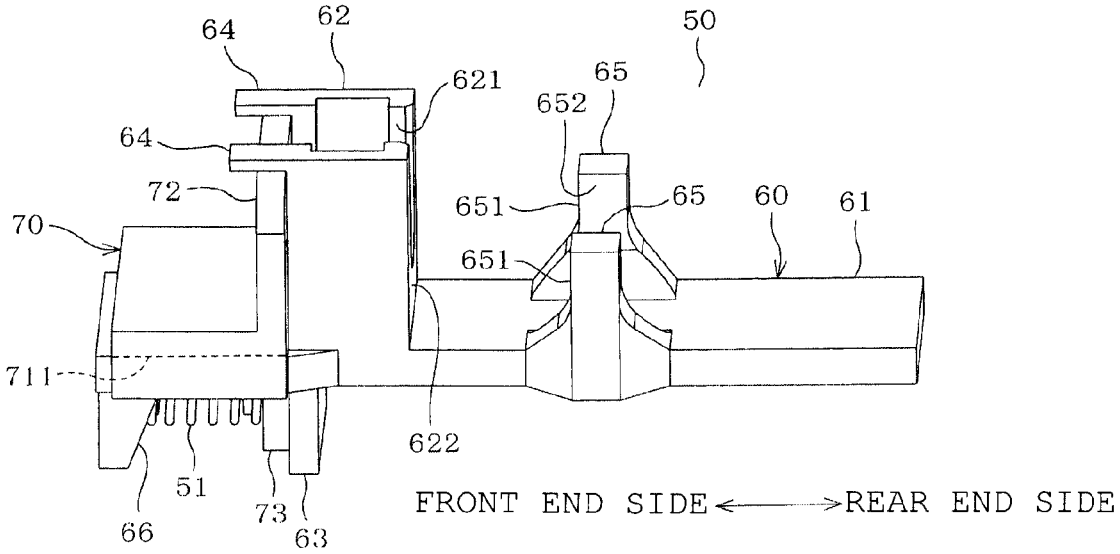

The support portion 62 is provided near the front end relative to the lengthwise center of the plate portion 61. The support portion 62 is formed into a rectangular block shape and protrudes at right angles to the plate portion 61 from a surface of the plate portion 61 as a whole. A U-shaped guide portion 621 is formed in a part of the U-shape inside the support portion 62. The guide portion 621 is open at the side opposed to the plate portion 61. The guide portion 621 has a widthwise dimension A which is set to be slightly larger than an outer diameter of the cap smaller-diameter part 432 as shown in FIG. 6A.

The support portion 62 has a rear end side surface serving as a seat 622. When the cartridge 40 is attached to the adjusting jig 50 a stepped portion 433 of the cap 43 abuts on the seat 622 as shown in FIG. 4. The retainer portion 64 is formed integrally with the support portion 62. The retainer portion 64 is formed into a rectangular plate shape and extends toward the front end side from the front end of the support portion 62.

Figure 7A:
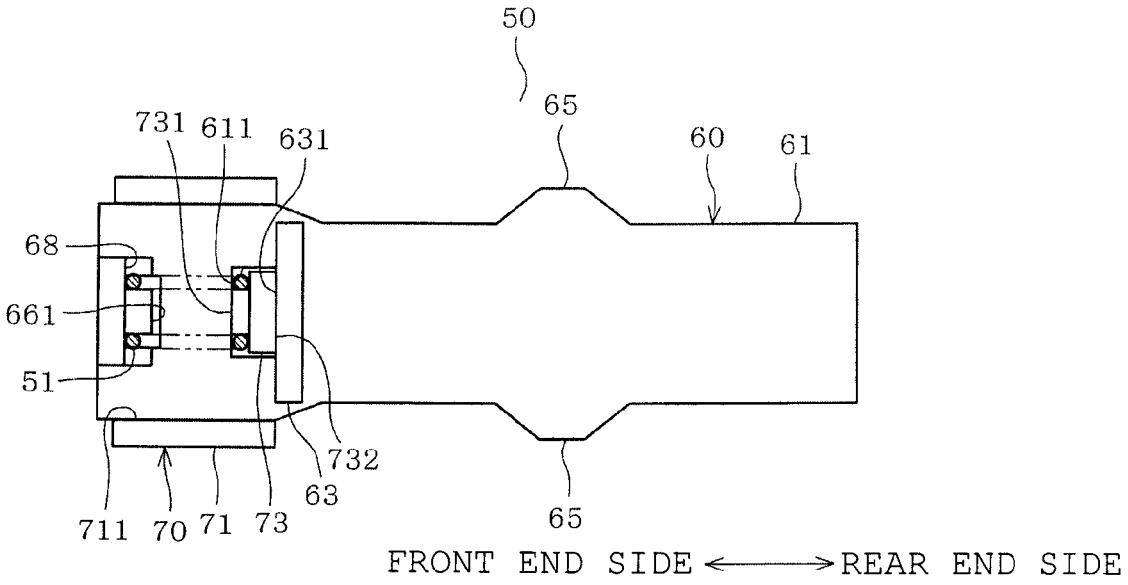
FIGS. 7A and 7B are a rear view and a longitudinally section of the adjusting jig.
Figure 7B:
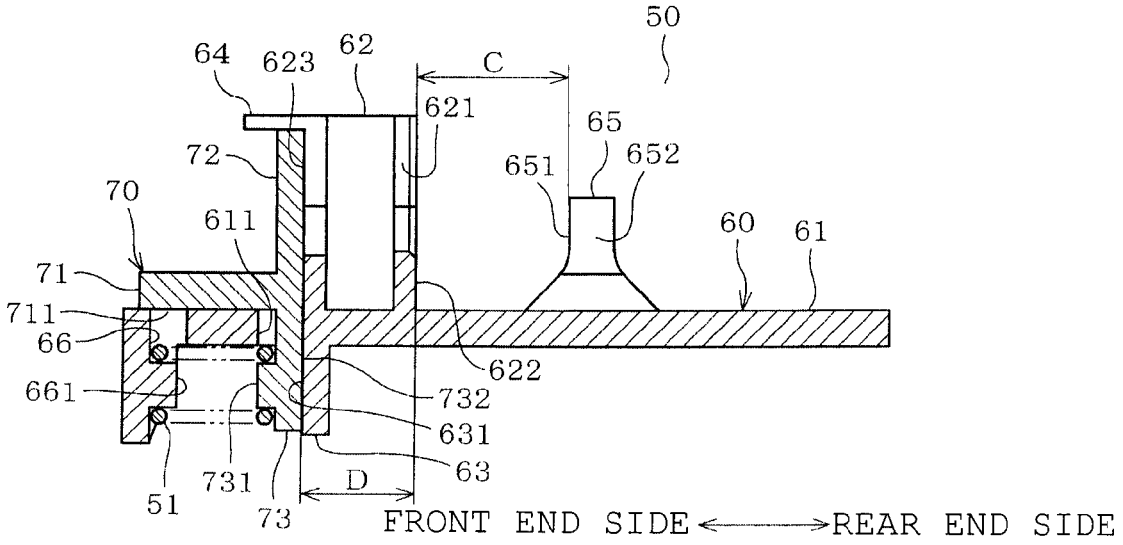

The first holding portion 63 is formed into a rectangular plate shape. The first holding portion 63 is located opposite the support portion 62 of the plate portion 61 and protrudes at right angles to the plate portion 61 from a surface of the plate portion 61 as a whole. As shown in FIG. 7B, the support portion 62 includes a front end side surface serving as a support front end surface 623. The first holding portion 63 includes a front end side surface serving as a first holding surface 631. The surfaces 623 and 631 are coplanar.

The preventing portions 65 are provided slightly near the rear end relative to the lengthwise center of the plate portion 61. The preventing portions 65 include two rectangular columns provided at both widthwise sides of the plate portion 61 respectively. The preventing portions 65 protrude at right angles to the plate portion 61 from surfaces of the plate portion 61 at the support portion 62 side respectively. In this case, the two preventing portions 65 and the plate portion 61 constitute the U-shape as shown in FIG. 6. The preventing portions 65 include front end side surfaces serving as movement preventing surfaces 651 and widthwise inner surfaces serving as rotation preventing surfaces 652 with respect to the plate portion 61, respectively.

In this case, a distance B between the rotation preventing surfaces 652 of the two preventing portions 65 is set at a value smaller than an outer diameter of the body larger-diameter part 411 of the cartridge 40 and an outer diameter of the cap larger-diameter part 431 and also slightly larger than a distance between the two opposite flat surfaces 413 of the body 41. Furthermore, a distance C between the seat 622 of the support portion 62 and the movement preventing surfaces 651 of the preventing portions 65 is set at a slightly larger value than a distance from the stepped portion 433 of the cap 43 to a rear end of the cap larger-diameter part 431, namely, a lengthwise dimension of the cap larger-diameter part 431. A distance D from the seat 622 to the first holding surface 631 is set at a value equal to a distance from the stepped portion 433 of the cap 43 to the lower end 434 of the cap smaller-diameter part 432, namely, a lengthwise dimension of the cap smaller-diameter part 432.

The spring-shoe 66 is formed into a rectangular plate shape and provided on the front end side of the plate portion 61. The spring-shoe 66 protrudes at right angles to the plate portion 61 from a surface of the plate portion 61 located at the first holding portion 63 side. The spring-shoe 66 is parallel to the first holding portion 63. A first protrusion 661 is located at the rear end side of the spring-shoe 66, that is, at the first holding portion 63 side and protrudes toward the first holding portion 63 side into a cylindrical shape.

The moving member 70 includes a main portion 71, an extending portion 72 and a second holding portion 73. The moving member 70 is formed into a T-shape as a whole. The main portion 71 is formed into the rectangular plate shape and has a groove 711. The groove 711 is formed at the plate portion 61 side in the main portion 71 and has a recessed shape in conformity to the shape of the plate portion 61. The groove 711 is fitted in the plate portion 61 of the base member 60. The extending portion 72 is formed into a substantially rectangular plate shape and protrudes at right angles in the rear end side portion of the main portion 71. In this case, the moving member 70 is formed into an L shape at the main and extending portions 71 and 72. The extending portion 72 includes an end adapted not to be detached from the plate portion 61 by the retainer portion 64. As a result, the moving member 70 is slidable on the plate portion 61 in the lengthwise direction within the range of the retainer portion 64.

The second holding portion 73 is formed into a plate shape and has a smaller width than the insertion hole 611 formed in the plate portion 61. The second holding portion 73 is located at the rear end side of the main portion 71 and protrudes at right angles. The second holding portion 73 constitutes the holding portion together with the first holding portion 63 and is inserted through the insertion hole 611 of the plate portion 61. The second holding portion 73 is opposed to the spring-shoe 66 of the base member 60 and includes a second protrusion 731 which is located at the front end side thereof, that is, at the spring-shoe 66 side and protrudes to the front end side into a cylindrical shape. The first protrusion 661 of the spring-shoe 66 is opposed to the second protrusion 731 of the second holding portion 73. In this case, the second holding portion 73 includes a surface which is located at the rear end side, that is, the surface which is opposed to the first holding surface 631. The surface serves as a second holding surface 732.

The compression soil spring 51 is provided between the spring-shoe 66 of the base member 60 and the second holding portion 73 and supported by the first and second protrusions 661 and 731. The moving member 70 is subjected to a biasing force of the compression coil spring 51, which biases the moving member 70 in a direction such that the moving member 70 comes close to the first holding portion 63 side of the base member 60, namely, such that the moving member 70 is moved to the rear end side of the adjusting jig 50. In this case, the compression coil spring 51 functions as a biasing member which biases the moving member 70 to the rear end side.

Figure 8:
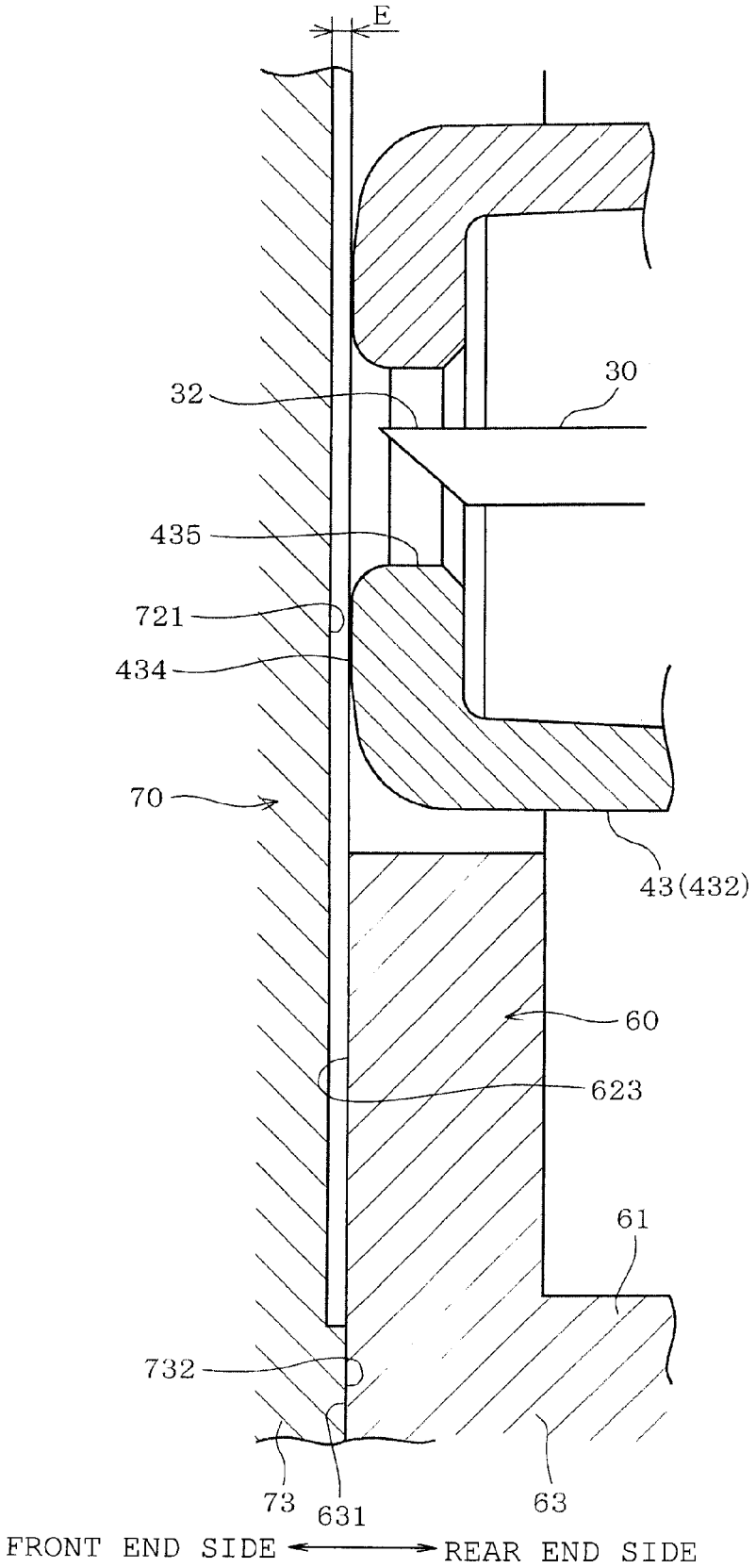
FIG. 8 is a partially enlarged view shoving the blade portion and its periphery and the adjusting jig in the state where the cartridge is attached.

The extending portion 72 has a surface which is located at the rear end side and formed with a recess 721 which is recessed by a predetermined distance relative to the second holding surface 732 of the second holding portion 73, as shown in FIG. 8. The recess 721 has a depth set to range substantially from 0.01 to 0.05 mm. In this case, the first holding surface 631 of the base member 60 is in abutment with the second holding surface 732 of the moving member 70 when the moving member 70 is located at an initial position where the moving member 70 is stationary. On the other hand, the support portion front end surface 623 of the base member 60 is not in abutment with the recess 721 of the moving member 70 when the moving member 70 is located at the initial position, whereupon a slight gap is defined by the recess 721. More specifically, when the moving member 70 is located at the initial position, the recess 721 is spaced away from the pressing surface 434 of the cap 43 by a predetermined distance, in this case, by the depth E of the moving member 70, 0.01 to 0.05 mm.

The following describes a manner of adjusting an amount of projection of the blade 32 of the cutter 30 provided in the cartridge 40 using the adjusting jig 50. After having attached the cutter 30 to the cartridge 40, the user attaches the adjusting jig 50 to the cartridge 40 while the cutter 30 is located inside the cap 43. In this case, the cartridge 40 is attached to the adjusting jig 50 in the state where the cap larger-diameter part 431 enters a space between the seat 622 of the support portion 62 and the movement preventing surface 651 of the preventing portion 65 and the cap smaller-diameter part 432 enters the guide portion 621, as shown in FIGS. 4A and 4B. In this case, since the stepped portion 433 of the cap larger-diameter part 431 abuts on the seat 622 of the support portion 62, the cartridge 40 is prevented from movement to the front end side in the lengthwise direction. Furthermore, since a part of the cap larger-diameter part 431 located at the rear end side abuts on the movement preventing surfaces 651 of the preventing portions 65, the cartridge 40 is prevented from movement to the rear end side in the lengthwise direction. Thus, the cap 43 is held so as to be immovable in the lengthwise direction but so as to be rotatable while attached to the adjusting jig 50.

The cartridge 40 is attached to the adjusting jig 50 so that the two fiat surfaces 413 are inserted between the rotation preventing surfaces of the preventing portions 65 respectively. As a result, the body 41 is held to be non-rotatable even when the cap 43 is rotated. On the other hand, the body 41 is allowed to move in the lengthwise direction. Thus, the base member 60 of the adjusting jig 50 holds the cap 43 so that the cap 43 is rotatable and immovable in the lengthwise direction and further holds the body 41 so that the body 41 is non-rotatable and immovable in the lengthwise direction.

Figure 9:
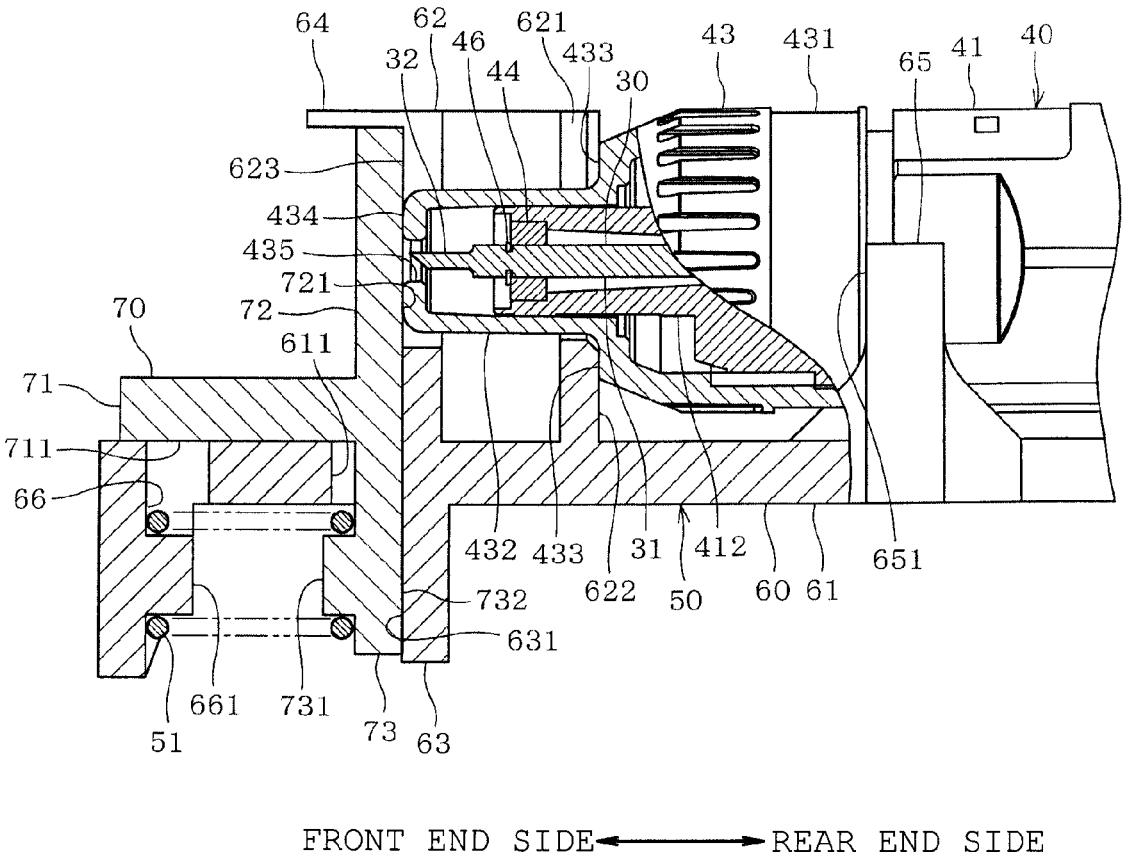
FIG. 9 shows the adjusting jig located at an initial position.

When the blade 32 of the cutter 30 is located inside the cap 43, the distal end of the blade 32 of the cotter 30 is spaced away from the recess 721 of the moving member 70 even if the moving member 70 is located at the initial position, as shown in FIGS. 8 and 9. On the other hand, the first holding surface 631 or the first holding portion 63 of the base member 60 is in abutment with the second holding surface 732 of the second holding portion 73 of the moving member 70 when the moving member 70 is located at the initial position.

Figure 10:
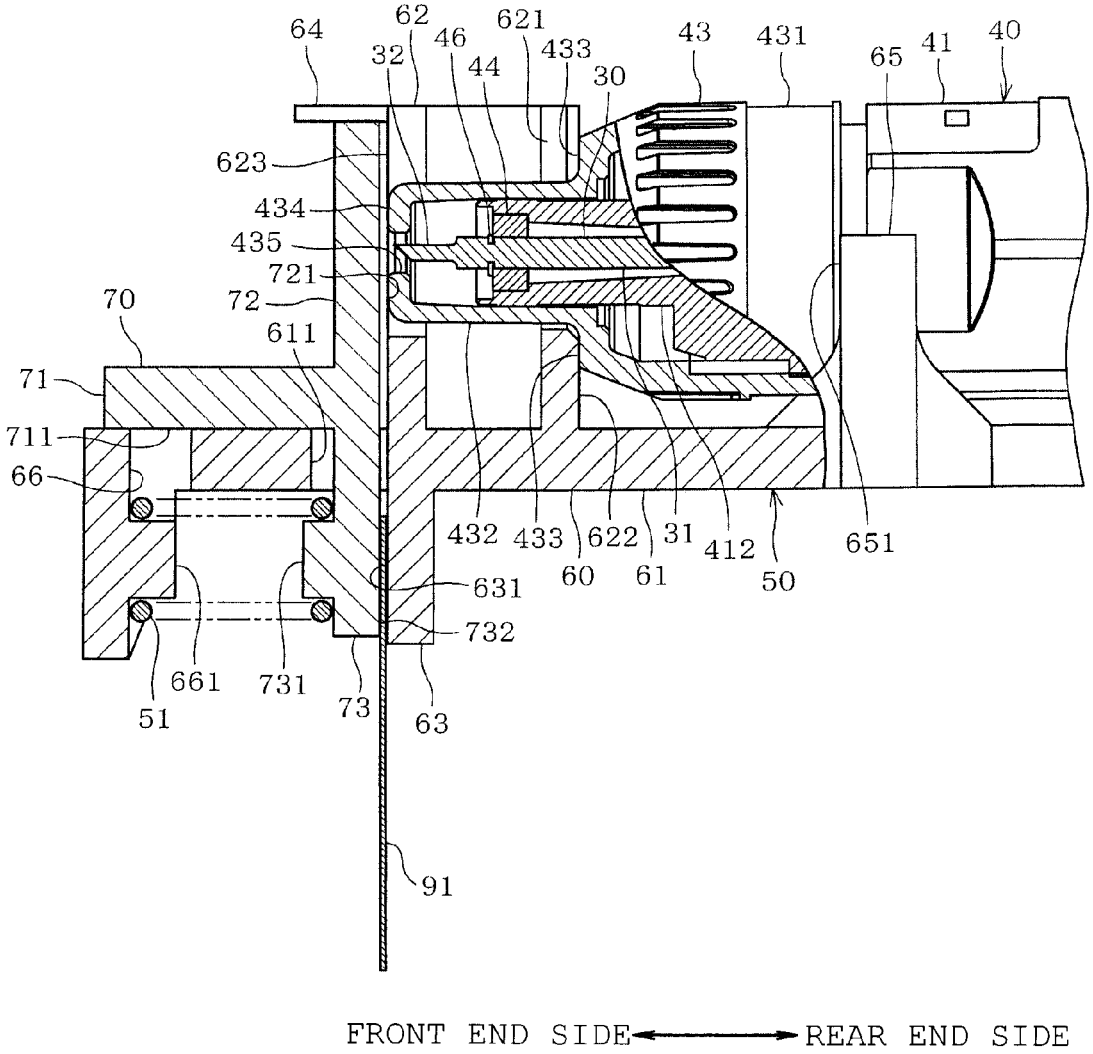
FIG. 10 shows the adjusting jig in the state where a holding portion holds a cut portion.
Figure 11:
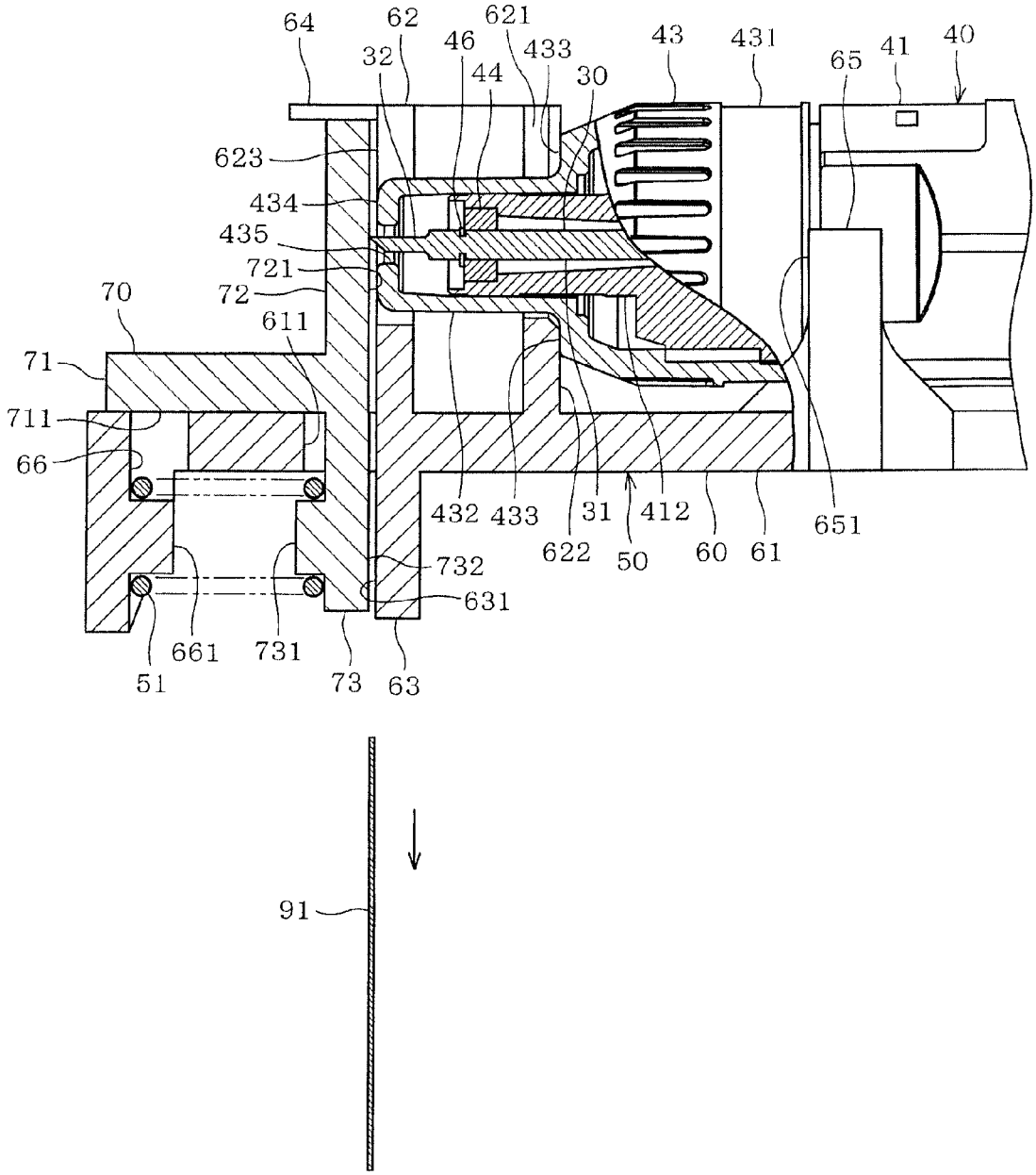
FIG. 11 shows the adjusting jig in the state where the cut portion has detached from the holding portion by self-weight.

The user then moves the moving member 70 to the front end side against the biasing force of the compression coil spring 51, as shown in FIG. 10. This causes the first holding surface 631 of the first holding portion 63 to depart from the second holding surface 732 of the second holding portion 73. Subsequently, the user puts the sheet-shaped object 91 between the first and second holding surfaces 631 and 732. The user then closes the first and second holding surfaces 631 and 732 so that the object 91 is held between the first and second holding surfaces 631 and 732. Thus, the holding portion constituted by the first and second holding surfaces 631 and 732 holds the sheet-shaped object 92 from both thicknesswise sides of the object 91. A part of the object 91 may be formed into a small piece, which may be held, instead of holding the whole object 91 on the holding portion. Note that FIGS. 10 and 11 show the object 91 formed into a small piece.

Subsequently, the user rotates the cap 43 in a direction such that the amount of projection of the blade 32 is increased, that is, in a direction such that the cap 43 is screwed into the body 41, or in the clockwise direction, while the adjusting jig 50 is held to be non-rotatable. Since the cap 43 is held by the adjusting jig 50 so as to be unmovable in the lengthwise direction of the cartridge 40, the body 41 holding the cutter 30 is drawn to the cap 43 side, whereby the amount of projection of the blade 32 is increased through the hole 435 of the cap 43.

The distal end of the blade 32 abuts on the recess 721 of the moving member 70 when the projection amount or the blade 32 is increased. Thereafter, when the projection amount of the blade 32 is further increased, the blade 32 presses the moving member 70, so that the moving member 70 is moved against the biasing force of the compression coil spring 51. As a result, the second holding portion 73 of the moving member 70 departs from the first holding portion 63 of the base member 60. More specifically, a holding force of the first and second holding portions 63 and 73 is reduced, so that the object 91 is detached by the self-weight from the first and second holding portions 63 and 73 to fall as shown in arrow in FIG. 11. Thus, when the object 91 is detached by the self-weight from the first and second holding portions 63 and 73, an appropriate projection amount is obtained.

According to the above-described construction, the user can easily adjust the projection amount of the blade 32 using the adjusting jig 50. More specifically, when adjusting the projection amount of the blade 32, the user rotates the cap 43 with the cartridge 40 attached to the adjusting jig 50 thereby to project the blade 32 until the object 91 is detached from the first and second holding portions 63 and 73. As a result, when the object 91 is detached from the first and second holding portions 63 and 73, the user understands that the projection amount of the blade 32 becomes appropriate. In other words, the user can definitely find that the projection amount of the blade 32 becomes appropriate, without visually confirming the projection amount of the small blade 32. Thus, the projection amount of the blade 32 can be easily adjusted.

Furthermore, the slight recess 721 is formed in the extending portion 72 of the moving member 70. When the moving member 70 is located at the initial position, the recess 721 of the moving member 70 is not adjacent to support portion front end surface 623 of the base member 60 and the pressing surface 434 of the moving member 70 although adjacent to the first holding surface 631 of the base member 60 and the second holding surface 732 of the moving member 70. According to this, the blade 32 can be projected more by an amount corresponding to a depthwise dimension of the recess 721 of the moving member 70 when the projection amount of the blade 32 is adjusted. More specifically, addition of the depthwise dimension (about 0.01 to 0.05 mm) of the recess 721 of the moving member 70 to the thickness of the object 91 can be determined to be an appropriate projection amount of the blade 32. Accordingly, the projection amount of the blade 32 can be easily adjusted so as to be slightly larger than the thickness of the object 91. Consequently, occurrence of cutting failure that the object 91 is not cut can be reliably prevented. Furthermore, the depth of cutting mark in the holding member 90 can be rendered minimum and wear of the blade 32 can be rendered as small as possible. In other words, the durability of the holding member 90 and the blade 32, that is, the cutter can be improved.

The above-described examples should not be restrictive but may be modified or expanded without departing from the gist. For example, an extension coil spring may be provided instead of the compression coil spring 51. In this case, the extension coil spring may have one end provided on the moving member 70 and the other end provided nearer the rear end side of the base member 60 than the first holding portion 63.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

What is claimed is:

1. A cutter cartridge device comprising:

a cartridge having a cutter including a blade portion, the blade portion being configured so that an amount of projection thereof projecting from the cartridge is changeable; and an adjusting jig including an attachment portion configured so that the cartridge is detachably attached to the attachment portion and a holder portion configured to hold a sheet-shaped cut object from both thicknesswise ends with respect to the cut object, the holder portion having a spacing which is changed in conjunction with a change in the projection amount of the blade portion of the cartridge attached to the attachment portion, wherein the cartridge further includes a body extending in a lengthwise direction and having a distal end holding the cutter and a cap having a hole through which the blade portion is capable of penetrating, the cap covering the cutter, wherein the cap is threadingly engageable with the body so as to be rotatable and is moved in the lengthwise direction according to rotation of the cap, thereby changing the projection amount of the blade portion projecting from the hole;

wherein the attachment portion has a base member configured to hold the cap so that the cap is rotatable and immovable in the lengthwise direction, the base member being further configured to hold the body so that the body is non-rotatable and movable in the lengthwise direction;

wherein the holder portion has a first holding portion formed integrally with the base member and a second holding portion formed integrally with a moving member and configured to be abuttable on the first holding portion;

wherein the moving member is supported on the base member so as to be movable in the lengthwise direction, the blade portion contacting the moving member thereby to press the moving member so that the moving member is moved in the lengthwise direction; and wherein the adjusting jig further includes a biasing member configured to bias the moving member in a direction such that the second holding portion comes close to the first holding portion.

2. The device according to claim 1, wherein the moving member is located at an initial position when not pressed by the blade portion, and the moving member is spaced from the cap by a predetermined distance when located at the initial position.

3. An adjusting jig comprising:

an attachment portion configured so that a cartridge is detachably attached thereto, the cartridge being provided with a cutter having a blade capable of appearing out of and disappearing into the cartridge, the blade being changeable in an amount of projection from the cartridge; and a holder portion configured to hold a sheet-shaped cut object from both thicknesswise ends with respect to a cut object, the holder portion having a spacing which is changed in conjunction with a change in the projection amount of a blade portion of the cartridge attached to the attachment portion, wherein the attachment portion has a base member configured to hold a cap of the cartridge so that the cap is rotatable and immovable in the lengthwise direction, the base member being further configured to hold a body of the cartridge so that the body is non-rotatable and movable in the lengthwise direction;

wherein the holder portion has a first holding portion formed integrally with the base member and a second holding portion formed integrally with a moving member and configured to be abuttable on the first holding portion;

wherein the moving member is supported on the base member so as to be movable in the lengthwise direction, the blade portion contacting the moving member thereby to press the moving member so that the moving member is moved in the lengthwise direction; and wherein the adjusting jig further includes a biasing member configured to bias the moving member in a direction such that the second holding portion comes close to the first holding portion.

4. The jig according to claim 3, wherein the moving member is located at an initial position when not pressed by the blade portion, and the moving member is spaced from the cap by a predetermined distance when located at the initial position.

5. A cutting apparatus comprising:

a cartridge having a cutter including a blade portion, the blade portion being configured so that an amount of projection thereof projecting from the cartridge is changeable; and an adjusting jig including:

an attachment portion configured so that the cartridge is detachably attached to the attachment portion;

a holder portion configured to hold a sheet-shaped cut object from both thicknesswise ends with respect to the cut object, the holder portion having a spacing which is changed in conjunction with a change in the projection amount of the blade portion of the cartridge attached to the attachment portion;

a holding member configured to hold the object; and a moving unit configured to move the holding member and the cartridge relative to each other, wherein the cartridge further includes a body extending in a lengthwise direction and having a distal end holding the cutter and a cap having a hole through which the blade portion is capable of penetrating, the cap covering the cutter, wherein the cap is threadingly engageable with the body so as to be rotatable and is moved in the lengthwise direction according to rotation of the cap, thereby changing the projection amount of the blade portion projecting from the hole;

wherein the attachment portion has a base member configured to hold the cap so that the cap is rotatable and immovable in the lengthwise direction, the base member being further configured to hold the body so that the body is non-rotatable and movable in the lengthwise direction;

wherein the holder portion has a first holding portion formed integrally with the base member and a second holding portion formed integrally with a moving member and configured to be abuttable on the first holding portion;

wherein the moving member is supported on the base member so as to be movable in the lengthwise direction, the blade portion contacting the moving member thereby to press the moving member so that the moving member is moved in the lengthwise direction; and wherein the adjusting jig further includes a biasing member configured to bias the moving member in a direction such that the second holding portion comes close to the first holding portion.

* * * * *